US010490911B2

(12) United States Patent
Zhou

(10) Patent No.: US 10,490,911 B2
(45) Date of Patent: Nov. 26, 2019

(54) INDIVIDUALIZED SPLIT-TYPE TOOL-FREE CONVENIENT INTELLIGENT INFORMATION PLUG

(71) Applicant: Ningbo Betterbell Telecommunication Equipment Co., Ltd., Cixi Ningbo (CN)

(72) Inventor: Zhanli Zhou, Cixi Ningbo (CN)

(73) Assignee: NINGBO BETTERBELL TELECOMMUNICATION EQUIPMENT CO., LTD., Cixi Ningbo (CN)

( * ) Notice: Subject to any disclaimer, the term of this patent is extended or adjusted under 35 U.S.C. 154(b) by 0 days.

(21) Appl. No.: 16/083,252

(22) PCT Filed: Jun. 24, 2016

(86) PCT No.: PCT/CN2016/087038
§ 371 (c)(1),
(2) Date: Sep. 7, 2018

(87) PCT Pub. No.: WO2017/152543
PCT Pub. Date: Sep. 14, 2017

(65) Prior Publication Data

US 2019/0058266 A1 Feb. 21, 2019

(30) Foreign Application Priority Data

Mar. 9, 2016 (CN) ..... 2016 1 0131255

(51) Int. Cl.
*H01R 13/62* (2006.01)
*H01R 4/2433* (2018.01)
(Continued)

(52) U.S. Cl.
CPC ..... *H01R 4/2433* (2013.01); *H01R 13/02* (2013.01); *H01R 13/501* (2013.01);
(Continued)

(58) Field of Classification Search
CPC ..... H01R 13/62938; H01R 13/6633; H01R 13/62933; H01R 13/658
(Continued)

(56) References Cited

U.S. PATENT DOCUMENTS 5,409,400 A * 4/1995 Davis ..... H01R 24/60 439/607.48
7,371,111 B2 * 5/2008 McCarthy ..... H01R 9/0503 439/578
(Continued)

FOREIGN PATENT DOCUMENTS

CN 2484674 Y 4/2002
CN 2484674 Y 4/2002
(Continued)

OTHER PUBLICATIONS

The World Intellectual Property Organization (WIPO) International Search Report for PCT/CN2016/087038 dated Dec. 13, 2016 6 Pages.
(Continued)

*Primary Examiner* — Phuong Chi Thi Nguyen
(74) *Attorney, Agent, or Firm* — Anova Law Group, PLLC

(57) ABSTRACT

Disclosed is an individualized split-type tool-free convenient intelligent information plug. A slot (2) is provided in the middle of the plug (1). An elastic sheet (3), a circuit board (4) and a cover board (5) are sequentially arranged on the slot (2). Metal contact pieces (6) are arranged on the cover board (5). Contact pins (7) extend downwardly from the lower ends of the metal contact pieces (6). The circuit board (4) is provided with through holes (8) for the insertion of the contact pins (7). An upper cover shell (9) and a lower cover shell (10) are arranged at the tail end of the plug (1). The plug (1) further comprises a cable insertion module (11). The front end of the cable insertion module (11) is provided
(Continued)

with an insertion slot for the insertion of the circuit board (4), and the upper end surface and lower end surface of the cable insertion module (11) are provided with grooves (13) for the placement of cable conductors. Metal connecting parts (14) are arranged in the grooves (13). The upper ends of the metal connecting parts (14) are provided with cutting notches (14-1), and the lower ends of the metal connecting parts (14) extend into the insertion slot of the cable insertion module (11) so as to be in contact with the circuit board (4). The plug is convenient to assemble, can be re-used, has a high interference resistance, can be upgraded, and meets the operating requirements of higher standards such as category 6 and augmented category 6. If some of the parts, such as the elastic sheet, are damaged, the parts can simply be dismounted and replaced, and the operation is extremely convenient and practical.

9 Claims, 3 Drawing Sheets

(51) Int. Cl.

| | |
|---|---|
| ***H01R 13/50*** | (2006.01) |
| ***H01R 13/66*** | (2006.01) |
| ***H01R 24/64*** | (2011.01) |
| ***H01R 13/02*** | (2006.01) |
| ***H01R 13/502*** | (2006.01) |
| *H01R 13/627* | (2006.01) |
| *H01R 13/629* | (2006.01) |
| *H01R 13/648* | (2006.01) |

(52) U.S. Cl.
CPC ..... *H01R 13/502* (2013.01); *H01R 13/665* (2013.01); *H01R 13/6658* (2013.01); *H01R 24/64* (2013.01); *H01R 13/629* (2013.01); *H01R 13/6275* (2013.01); *H01R 13/648* (2013.01)

(58) Field of Classification Search
USPC ..... 439/157, 160, 372, 607.55
See application file for complete search history.

(56) References Cited

U.S. PATENT DOCUMENTS

| | | | | |
|---|---|---|---|---|
| 7,553,196 | B2 * | 6/2009 | Clark | H01R 13/506 439/676 |
| RE41,250 | E * | 4/2010 | Henneberger | H01R 13/4364 439/676 |
| 9,466,928 | B2 * | 10/2016 | Luettermann | H01R 13/514 |
| 2014/0273568 | A1 | 9/2014 | Lin | |
| 2014/0273658 | A1 | 9/2014 | Ackins | |

FOREIGN PATENT DOCUMENTS

| | | | |
|---|---|---|---|
| CN | 101145653 | A | 3/2008 |
| CN | 101145653 | A | 3/2008 |
| CN | 201515022 | U | 6/2010 |
| CN | 201515022 | U | 6/2010 |
| CN | 201570712 | U | 9/2010 |
| CN | 201570712 | U | 9/2010 |
| CN | 105655789 | A | 6/2016 |
| CN | 105655789 | A | 6/2016 |

OTHER PUBLICATIONS

"International Application Serial No. PCT/CN2016/087038, International Search Report dated Dec. 13, 2016", w/ English Translation, (dated Dec. 13, 2016), 6 pgs.
"International Application Serial No. PCT/CN2016/087038, Written Opinion dated Dec. 13, 2016", (dated Dec. 13, 2016), 4 pgs.

* cited by examiner

INDIVIDUALIZED SPLIT-TYPE TOOL-FREE CONVENIENT INTELLIGENT INFORMATION PLUG

FIELD OF THE INVENTION

The invention patent relates to an information plug, in particular to a tool-free information plug.

BACKGROUND

At present, the production and connection of cable heads require special cable clamps. The outer skin of the cable needs to be stripped first, and the internal fiber core is arranged according to the standard, then cut and the crystal head is inserted, and then fixedly connected by a special cable clamp. This method is inconvenient for installation, and it is easy to cause disconnection. It is required to cut and install again if the installation fails. For a cable disposed in the wall with a limited length, it is necessary to rearrange the cable after repeated failure of installation.

SUMMARY

In order to overcome the drawbacks of the inconvenient installation of crystal head, inability to disassemble after one-time installation and easy formation of disconnection, the present invention provides a convenient personalized split type tool-free intelligent information plug.

In order to solve the technical problems, the present invention adopts the following technical solutions: a convenient personalized split type tool-free intelligent information plug, having an open slot in the middle, and the open slot is sequentially provided with a spring piece, a circuit board, and a cover plate, and the cover plate is provided with a metal contact piece, the lower end of the metal contact piece has a contact pin extending downwardly, and the circuit board is provided with a through hole for inserting the contact pin, the end of the plug is provided with an upper cover case and a lower cover case, and further having a plug-in module, the front end of the plug-in module is provided with a slot for inserting a circuit board, and the upper end surface and the lower end surface of the plug-in module are provided with a groove for placing cable cores, the groove is provided with a metal connecting piece, the upper end of the metal connecting piece is provided with a broken wire port, and the lower end of the metal connecting piece is inserted into the slot of the plug-in module to be in contact with the circuit board.

Further, the inner surfaces of the upper cover case and the lower cover case are provided with a line-pressing protruding block corresponding to the groove on the plug-in module.

Further, the inner surfaces of the upper cover case and the lower cover case are provided with a locking protruding block for fixing the plug-in module against the rear end surface of the plug-in module.

Further, the metal connecting piece is in a form of a strip, and metal protruding pieces extend upwardly on both sides of the metal connecting piece, and the metal protruding pieces form a broken wire port, and the middle of metal connecting piece is bent downward into the slot of the plug-in module. The metal connecting piece is provided with barbs on the sides of the both ends, and the metal connecting piece is fixed in the slot of the plug-in module by the barbs.

Further, the plug is made of metal, and a contact strip is provided on the tail end of the plug extending rearwards. The grounding terminal is connected by the contact strip for shielding.

Further, the upper cover case or the lower cover case is provided with a semi-arc clip at the tail end, and buckles are provided at both ends of the clip, and the buckles of the clip are buckled on the side of the lower cover case or the upper cover case. An extension surface for attaching a label is further extended on the clip.

Further, an inner pressing piece is comprised, the inner pressing piece is disposed at the tail end of the lower cover case or the upper cover case, the inner pressing piece is a circular spring piece, and anti-slip bumps are provided on the surface of the inner pressing piece.

Further, the circuit board adopts a double-layer PCB, and the upper and lower layers of the circuit board are covered with copper shields, and the upper layer of copper is connected with the lower layer of copper on the circuit board via a plurality of holes, and the holes are prone to produce circuit interference and separation.

Further, a through hole is disposed in a middle of the circuit board, and the lower end surface of the cover plate is provided with a positioning post.

Further, the upper cover case and the lower cover case are hinged at the tail end of the plug.

Further, a dustproof plug is comprised, and the dustproof plug is disposed at the front end of the plug-in module. The dustproof plug helps protect the contacts of the metal connecting piece when not installed.

In the present invention, when the plug is used, the cable is placed in the groove of the plug-in module according to the line order, the front end of the plug-in module is plugged into the circuit board, and the upper cover case and the lower cover case are closed, at this time, the cable is pressed to the broken wire port of the metal connecting piece by the line-pressing protruding block, so that the fibre core and the metal connecting piece are connected. The plug-in module and the circuit board are tightly fixed by the locking protruding blocks on the upper cover case and the lower cover case, finally the clip is fixed and locked, to complete the installation. If the line order needs to be changed, loosen the clip and turn up the upper cover case and the lower cover case to adjust the line order, which is very convenient. The invention also supports upgrading and modification. After removing the cover plate, upgrading and modification can be performed by replacing the head portion (including the circuit board, the upper cover and lower cover). With the development of technology, the requirement for information rate is improved and information transmission technology is improved. If we want to upgrade the interfaces, we just need to replace them with circuit boards of higher performance and higher standard.

The present invention can achieve the following beneficial effects: easy to assemble, repeated use, strong anti-interference, supporting upgrading, applicable to higher standards such as Category 6 or higher. Some parts (such as spring piece) can be directly disassembled for replacement after damaged, so it is very convenient and practical.

DETAILED DESCRIPTION

The present invention is further described below in combination with accompanying drawings and specific embodiments.

Figure 1:
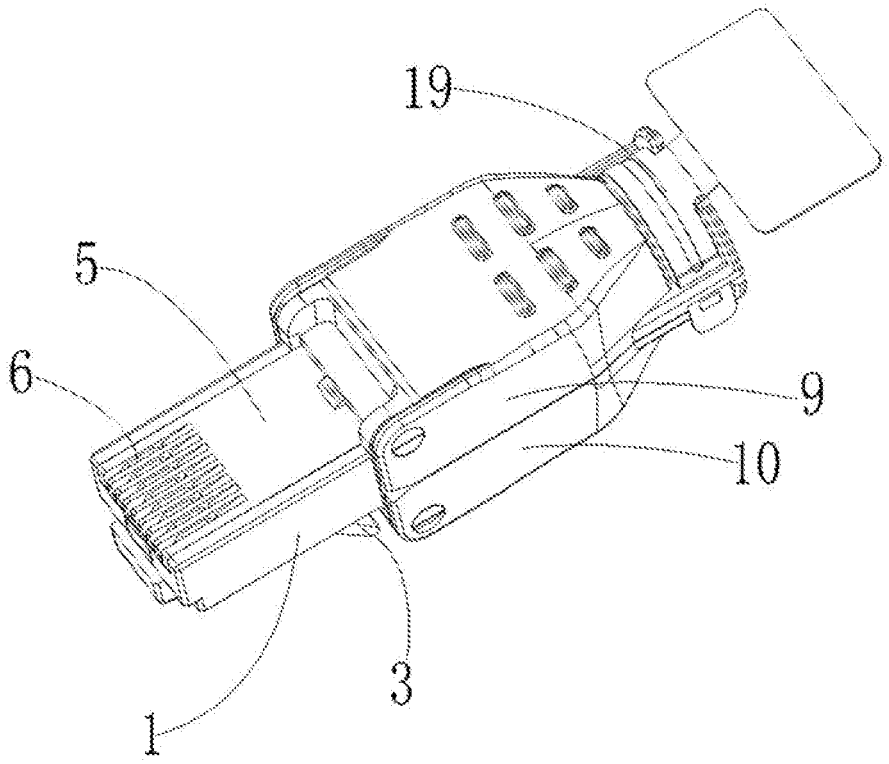
FIG. 1 is a perspective view of the present invention.
Figure 2:
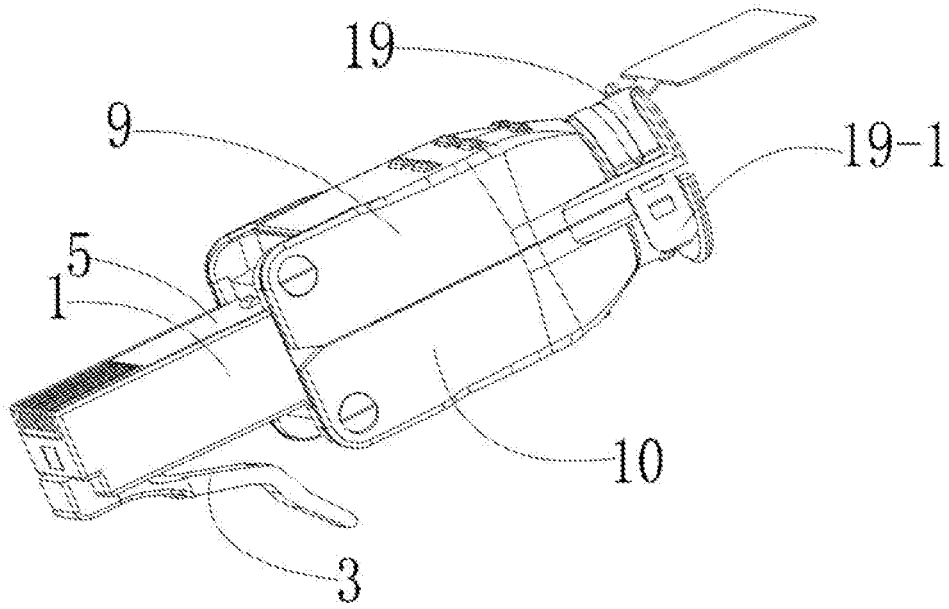
FIG. 2 is a perspective view of another perspective of the present invention.
Figure 3:
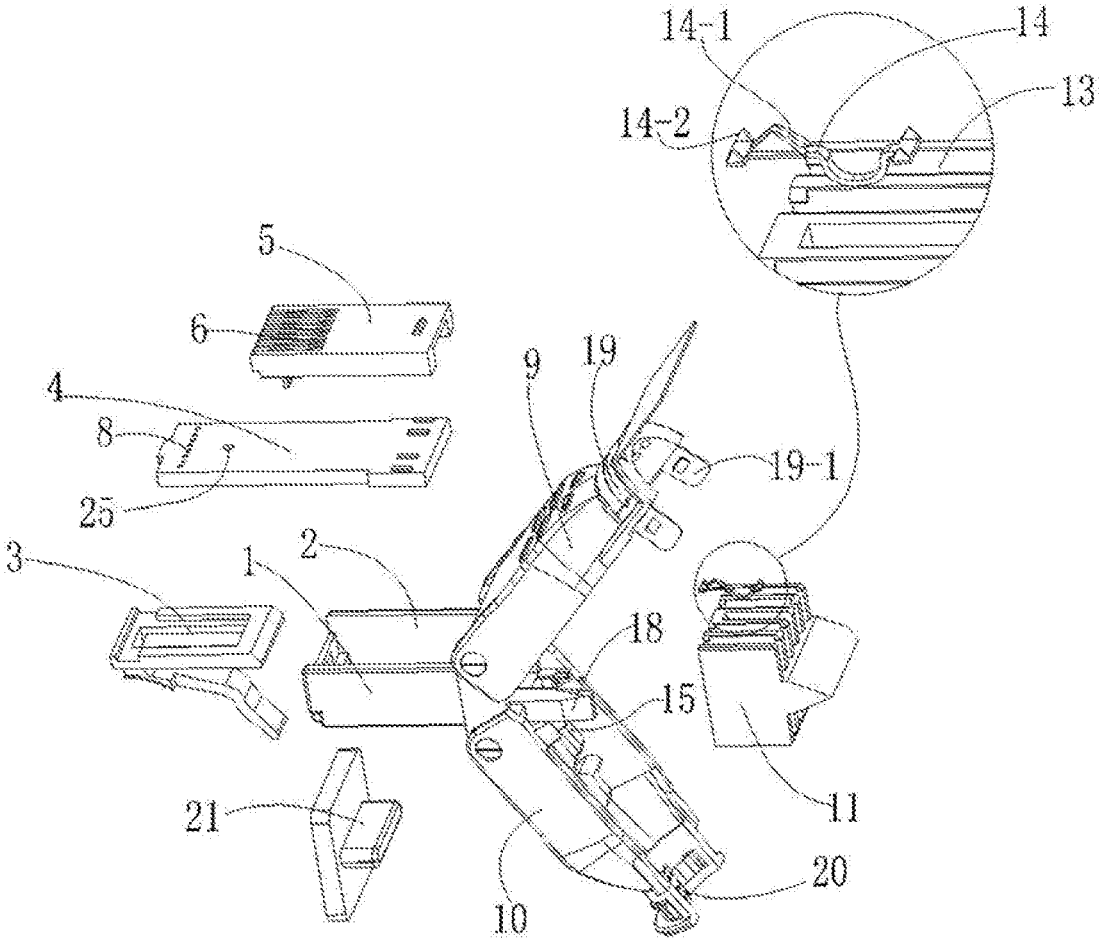
FIG. 3 is an exploded view of the present invention.
Figure 4:
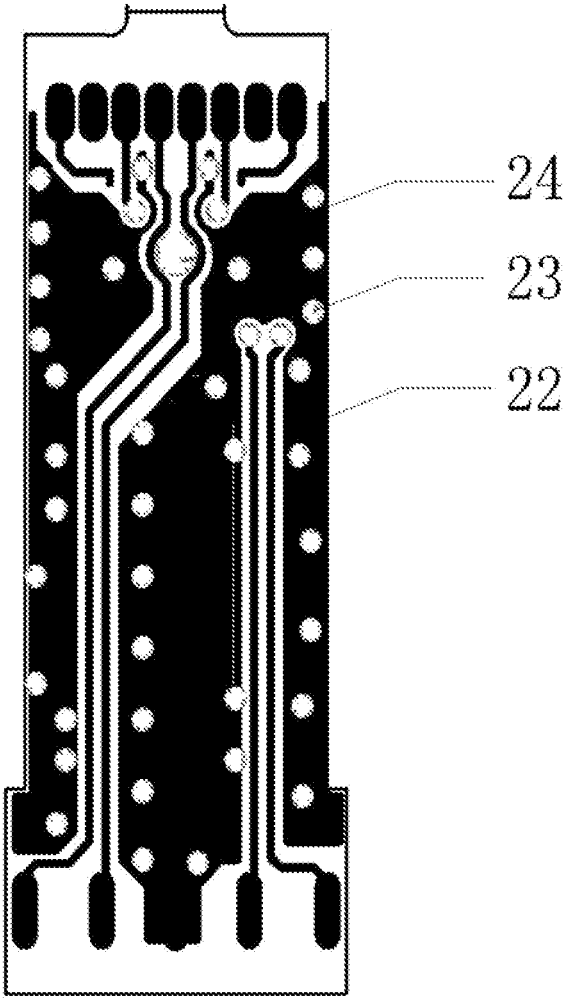
FIG. 4 is a schematic view of a circuit board of the present invention.

Referring to FIG. 1 to FIG. 4, a convenient personalized split type tool-free intelligent information plug, having an open slot 2 in the middle of the plug 1, and the open slot 2 is sequentially provided with a spring piece 3, a circuit board 4, and a cover plate 5, and the cover plate 5 is provided with a metal contact piece 6, the lower end of the metal contact piece 6 has a contact pin 7 extending downwardly, and the circuit board 4 is provided with a through hole 8 for inserting the contact pin, the end of the plug 1 is provided with an upper cover case 9 and a lower cover case 10, and further having a plug-in module 11, the front end of the plug-in module 11 is provided with a slot for inserting a circuit board, and the upper end surface and the lower end surface of the plug-in module 11 are provided with a groove 13 for placing cable cores, the groove is provided with a metal connecting piece 14, the upper end of the metal connecting piece 14 is provided with a broken wire port 14-1, and the lower end of the metal connecting piece 14 is inserted into the slot of the plug-in module to be in contact with the circuit board 4.

In this embodiment, the inner surfaces of the upper cover case 9 and the lower cover case 10 are provided with a line-pressing protruding block 15 corresponding to the groove 13 on the plug-in module.

In this embodiment, the inner surfaces of the upper cover case 9 and the lower cover case 10 are provided with a locking protruding block 16 for fixing the plug-in module against the rear end surface of the plug-in module.

In this embodiment, the metal connecting piece 14 is in a form of a strip, and metal protruding pieces 17 extend upwardly on both sides of the metal connecting piece 14, and the metal protruding pieces 17 form a broken wire port 14-1, and the middle of metal connecting piece 14 is bent downward into the slot of the plug-in module 11. The metal connecting piece is provided with barbs 14-2 on the sides of the both ends, and the metal connecting piece is fixed in the slot of the plug-in module by the barbs 14-2.

In this embodiment, the plug 1 is made of metal, and a contact strip 18 is provided on the tail end of the plug 1 extending rearwards. The grounding terminal is connected by the contact strip for shielding.

In this embodiment, the upper cover case 9 or the lower cover case 10 is provided with a semi-arc clip 19 at the tail end, and buckles 19-1 are provided at both ends of the clip 19, and the buckles 19-1 of the clip 19 are buckled on the side of the lower cover case 10 or the upper cover case 9. An extension surface for attaching a label is further extended on the clip.

In this embodiment, an inner pressing piece 20 is comprised, the inner pressing piece 20 is disposed at the tail end of the lower cover case 10 or the upper cover case 9, the inner pressing piece 20 is a circular spring piece, and anti-slip bumps are provided on the surface of the inner pressing piece 20.

In this embodiment, the circuit board adopts a double-layer PCB, and the upper and lower layers of the circuit board are covered with copper shields 22, and the upper layer of copper is connected with the lower layer of copper on the circuit board via a plurality of holes 23, and the holes are prone to produce circuit interference and separation.

In this embodiment, a through hole 25 is disposed in a middle of the circuit board, and the lower end surface of the cover plate is provided with a positioning post. The positioning post is inserted into the through hole to fix and limit each other.

In this embodiment, the upper cover case 9 and the lower cover case 10 are hinged at the end of the plug.

In this embodiment, a dustproof plug 21 is comprised, and the dustproof plug is disposed at the front end of the plug-in module. The dustproof plug helps protect the contacts of the metal connecting piece when not installed.

In the present invention, when the plug is used, the cable is placed in the groove 13 of the plug-in module 11 according to the line order, the front end of the plug-in module 11 is plugged into the circuit board, and the upper cover case 9 and the lower cover case 10 are closed, at this time, the cable is pressed to the broken wire port 14-1 of the metal connecting piece by the line-pressing protruding block 15, so that the fibre core and the metal connecting piece 14 are connected. The plug-in module and the circuit board are tightly fixed by the locking protruding blocks 16 on the upper cover case 9 and the lower cover case 10, finally the clip is fixed and locked, to complete the installation. If the line order needs to be changed, loosen the clip 19 and turn up the upper cover case 9 and the lower cover case 10 to adjust the line order, which is very convenient.

The present invention can achieve the following beneficial effects: easy to assemble, repeated use, strong anti-interference, supporting upgrading, applicable to higher standards such as Category 6 or higher. Some parts (such as spring piece) can be directly disassembled for replacement after damaged, so it is very convenient and practical.

What is claimed is:

1. A convenient personalized split type tool-free intelligent information plug, comprising:

an open slot in a middle, wherein the open slot is sequentially provided with a spring piece, a circuit board, and a cover plate, and the cover plate is provided with a metal contact piece, a lower end of the metal contact piece has a contact pin extending downwardly, and the circuit board is provided with a through hole for inserting the contact pin, an end of the plug is provided with an upper cover case and a lower cover case; and a plug-in module, wherein a front end of the plug-in module is provided with a slot for inserting the circuit board, and an upper end surface and a lower end surface of the plug-in module are provided with a groove for placing cable cores, the groove is provided with a metal connecting piece, an upper end of the metal connecting piece is provided with a broken wire port, and a lower end of the metal connecting piece is inserted into a slot of the plug-in module to be in contact with the circuit board;

wherein the metal connecting piece is in a form of a strip, and metal protruding pieces extend upwardly on both sides of the connecting, and the metal protruding pieces form a broken wire port, and the metal connecting piece is bent downward into the slot of the plug-in module.

2. The convenient personalized split type tool-free intelligent information plug according to claim 1, wherein inner surfaces of the upper cover case and the lower cover case are provided with a line-pressing protruding block corresponding to the groove on the plug-in module.

3. The convenient personalized split type tool-free intelligent information plug according to claim 1, wherein inner surfaces of the upper cover case and the lower cover case are provided with a locking protruding block for fixing the plug-in module against the rear end surface of the plug-in module.

4. The convenient personalized split type tool-free intelligent information plug according to claim 1, wherein the plug is made of metal, and a contact strip is provided on the tail end of the plug extending rearwards.

5. The convenient personalized split type tool-free intelligent information plug according to claim 1, wherein the circuit board adopts a double-layer PCB, and the upper and lower layers of the circuit board are covered with copper shields, and the upper layer of copper is connected with the lower layer of copper on the circuit board via a plurality of holes, and the holes are prone to produce circuit interference and separation.

6. The convenient personalized split type tool-free intelligent information plug according to claim 1, wherein a through hole is disposed in a middle of the circuit board, and the lower end surface of the cover plate is provided with a positioning post.

7. The convenient personalized split type tool-free intelligent information plug according to claim 1, wherein the upper cover case and the lower cover case are hinged at a tail end of the plug.

8. The convenient personalized split type tool-free intelligent information plug according to claim 1, wherein the upper cover case or the lower cover case is provided with a semi-arc clip at the tail end, and buckles are provided at both ends of the clip, and the buckles of the clip are buckled on the side of the lower cover case or the upper cover case.

9. The convenient personalized split type tool-free intelligent information plug according to claim 8, further comprising an inner pressing piece, wherein the inner pressing piece is disposed at a tail end of the lower cover case or the upper cover case, the inner pressing piece is a circular spring piece, and anti-slip bumps are provided on the surface of the inner pressing piece.

* * * * *